US005697747A

United States Patent [19]

Sawada et al.

[11] Patent Number: 5,697,747

[45] Date of Patent: Dec. 16, 1997

[54] BINDING MACHINE USING A TAPE AND A BINDING TAPE

[75] Inventors: Sueji Sawada; Masayuki Kasuya, both of Tokyo, Japan

[73] Assignee: Picard Co., Tokyo, Japan

[21] Appl. No.: 311,188

[22] Filed: Sep. 23, 1994

[30] Foreign Application Priority Data

| | | | |
|---|---|---|---|
| Oct. 1, 1993 | [JP] | Japan | 5-267809 |
| Aug. 3, 1994 | [JP] | Japan | 6-182446 |

[51] Int. Cl.[6] ..... B42B 5/00; B31B 1/90

[52] U.S. Cl. ..... 412/16; 412/36; 493/214; 493/223

[58] Field of Search ..... 412/6, 7, 33, 36, 412/16; 493/210, 214, 223, 227, 374, 393

[56] References Cited

U.S. PATENT DOCUMENTS

| | | | |
|---|---|---|---|
| 1,980,267 | 11/1934 | Gould et al. | 412/16 |
| 4,552,497 | 11/1985 | Kockler et al. | 412/36 X |
| 5,366,333 | 11/1994 | Crudo et al. | 412/16 |

FOREIGN PATENT DOCUMENTS

| | | | |
|---|---|---|---|
| 395161 | 2/1909 | France | 412/36 |
| 96182 | 5/1972 | France | 412/16 |

*Primary Examiner*—S. Thomas Hughes
*Attorney, Agent, or Firm*—Bauer & Schaffer

[57] ABSTRACT

A boring mechanism bores an aperture through a stack of papers and a binding mechanism inserts a bonding tape having adhesive on one side through the aperture and partially about the stack of papers.

4 Claims, 11 Drawing Sheets

1
C
c
6
8
7
10
14b
14
11b
14b1
49
21
18
17c
19a
19b
17a
17b
17
3
14a1
14a
14d
12d
14f
31
20
23
34
33
27a
27c
27
28
26a
26
32
30
29
25
13
13a
47
48
25
13
13a
15
15a
15b
2
16
16b
16a
12
12a
11
11a
21
22c
22a
22
23
43
42a
41a
42c
42b
44
45
42
41
40

BINDING MACHINE USING A TAPE AND A BINDING TAPE

BACKGROUND OF THE INVENTION

1. Field of the Invention

The present invention relates to a machine for binding papers and bag openings and, particularly, to a binding machine which bores an aperture through a bundle of papers and binds the papers with a paper tape inserted through the aperture.

2. Related Art:

An existing binding machine such as a Hotchkiss type stapling machine using a staple cartridge binds the papers by driving a metal staple into a bundle of the papers so that the needles of the staple pierce the bundle to project from the rear surface thus being bent inward to secure the papers.

The binding machine using a staple (a stapling machine) according to this method encounters disadvantages such that the staple is stuck into a user's finger by mistake when the papers are bound or the needles of the staple catch onto clothing or injure the user's skin if they are not satisfactorily bent. When the papers which are already bound are to be released because the papers are not satisfactorily bound or binding becomes unnecessary, a tool such as a staple remover is necessary. Without such tool, the user frequently uses his fingernail, resulting in broken and injured fingernails.

When unnecessary papers are fed into a paper cutting machine such as a shredder, it is necessary to first remove the staple from the bound papers. If the papers bound by a staple are fed into the paper cutting machine by mistake, the staple catches in the paper cutting machine, which causes trouble in the operation thereof, further damaging the blade of the paper cutting machine. This leads to reduction in the life of the cutting machine. An envelope is sometimes stapled and sealed by the stapling machine so that when a letter opener is used, trouble ensues. Therefore, in consideration of inconvenience in opening the envelope, it is not recommended to staple the envelope to seal it.

On the other hand, when many sheets of papers are bound by metal staples, the staples are placed only at an upper left-hand corner. Consequently, a pile of papers becomes extraordinarily thick at the stapled area, causing a problem in storage. In practice, the metal staple is not normally used to keep bundled papers for a long period of time. This practice seems to result from a property of the metal staple which causes it to rust comparatively early. It is often observed that no countermeasure can be taken after the metal staple binding the papers rusts. A string or binding ribbon and so on are practically used in lieu of the staple.

Further, when a bag of food is bound by a staple, it is sometimes observed that the released staple falls into the food. Even staples which are not intended to be released become inadvertently released and fall into the food. Thus, it is sometimes dangerous to staple the bag. Since both edges of the released staple are sharp, there is then the risk such that a finger, for example, is injured by the edges of the staple.

SUMMARY OF THE INVENTION

An object of the present invention is to provide a binding machine which employs a system of binding papers and other sheet material with a tape made of a material such as paper or the like, thus eliminating disadvantages of a conventional stapling machine. A binding tape is also provided.

In order to achieve the above objects, the binding machine according to the present invention uses a tape coated with an adhesive. The machine is provided with a boring mechanism for cutting an aperture through the papers or sheets to be bound. A binding mechanism winds the tape around or halfway around the bored aperture and an end portion of the papers or onto another aperture binding the tape to the papers by pressing it and the papers together.

The binding tape for use in the binding machine of the present invention is formed by securing a bonding tape cut at predetermined intervals to an carrier tape so as to be capable of being peeled off in discrete sections from the latter.

DESCRIPTION OF THE PREFERRED EMBODIMENT

A binding machine using a tape and a binding tape used therein according to an embodiment of the present invention will hereinafter be explained with reference to the attached drawings.

Figure 1:
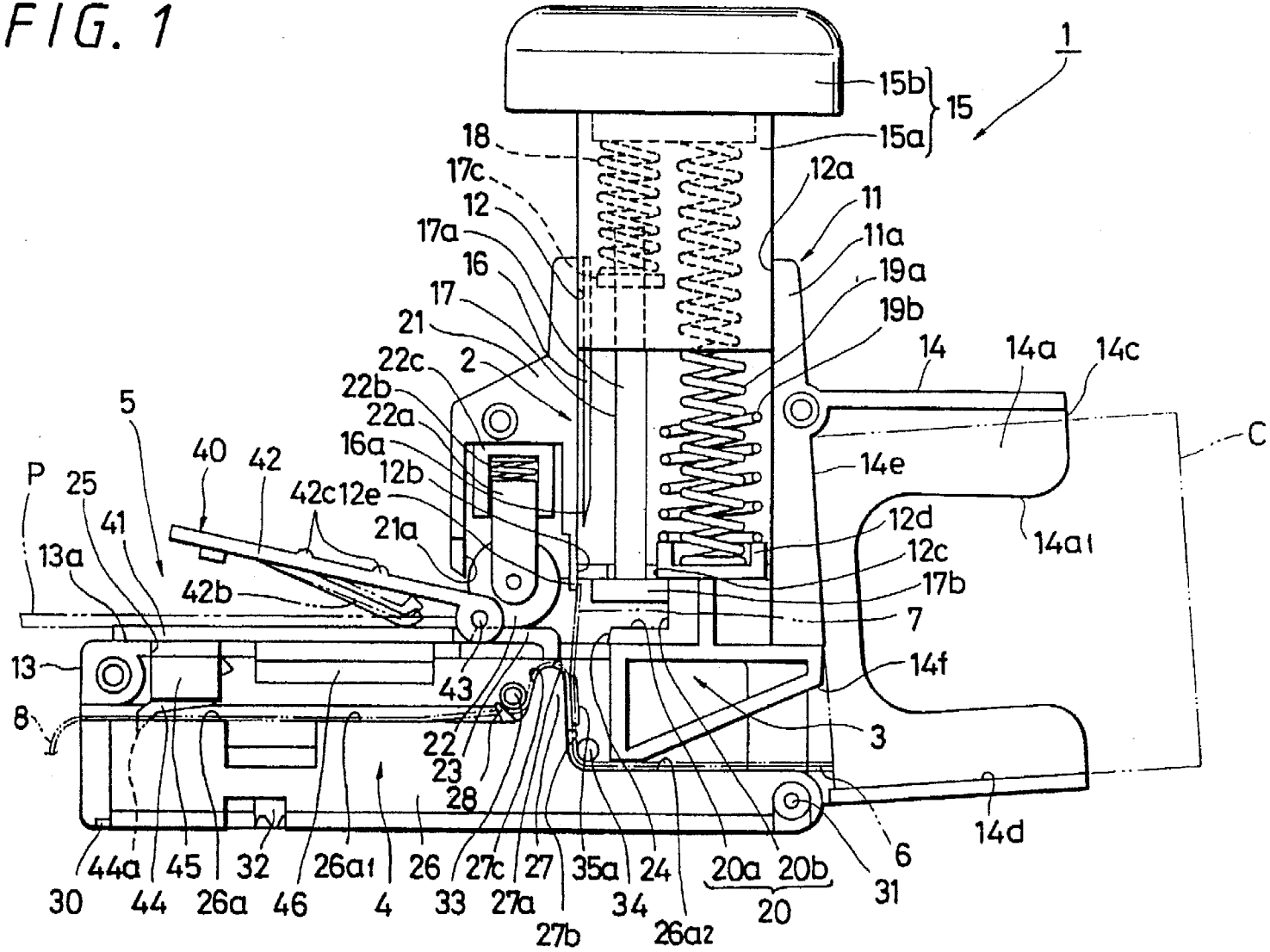
FIG. 1 is a partially sectioned side elevational view showing a binding machine using a tape according to the present invention.

FIG. 1 is a side elevational view showing the binding machine, generally depicted by the numeral 1, of the present invention in which the right side wall is removed. The binding machine 1 comprises a boring mechanism 2, a binding mechanism 3, including a binding-tape forwarding and guiding mechanism 4, and a feed mechanism 5 for moving papers or other material to be bound. A substantially endless roll of a binding tape assembly 6 is loaded into a cassette holder 14 at the rear of the binding machine 1.

Figure 2:
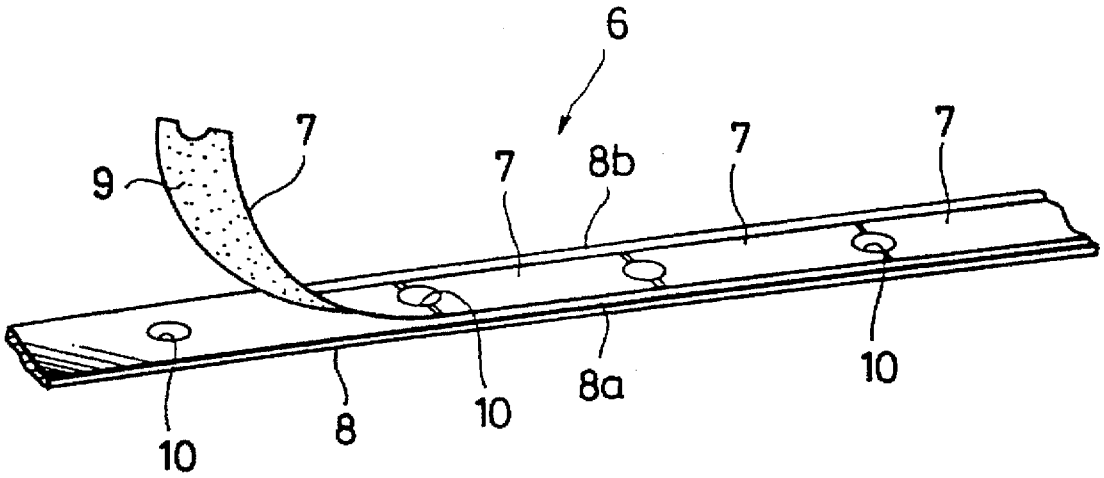
FIG. 2 is a perspective view of a binding tape assembly according to the present invention.

As seen in FIG. 2, the binding tape assembly 6 comprises a layer of a bonding tape 7 and a carrier layer of quickrelease tape 8. In the embodiment shown, the bonding tape 7 comprises a plurality of discrete tape units 7', each coated on their rear surface with self-adhesive 9 and uniformly precut to provide a unit length per tape determined on the basis of the thickness and width of the papers to be bound.

Figure 3:
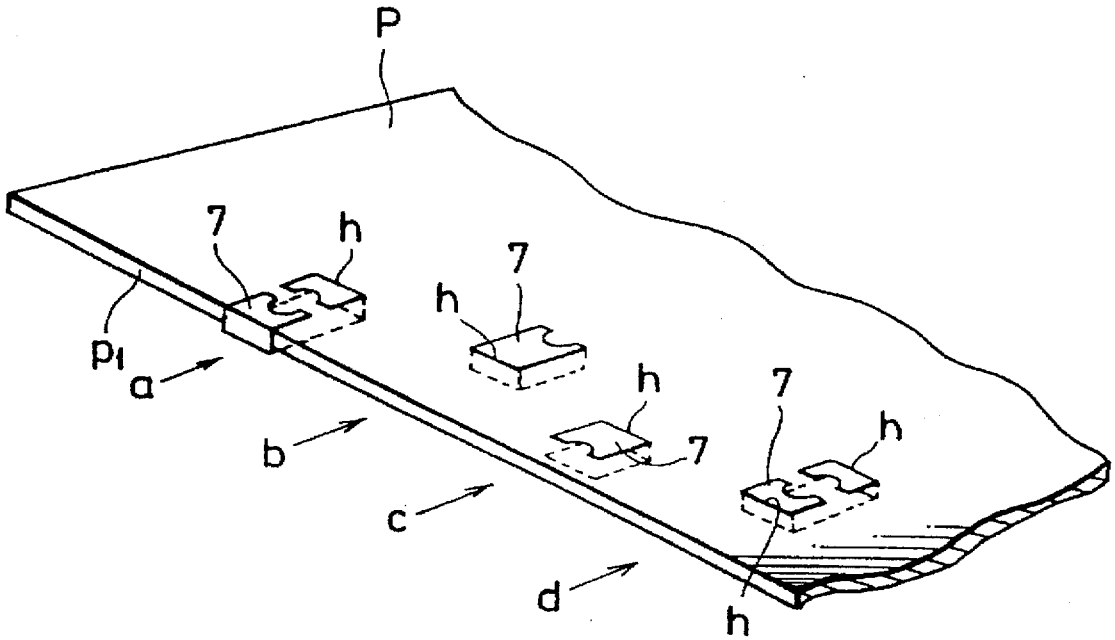
FIG. 3 is a perspective view showing various kinds of tape bindings.

As shown in FIG. 3, the unit length of each bonding tape 7 is obtained by adding the distance equal to twice the length from the edge surface $p_1$, of the stack of papers P to be bound, to a slit-shaped aperture h bored through the stack of papers P and the distance equal to twice the thickness of the stack of papers P. This unit length is calculated to provide a length of bonding tape 7 sufficient to substantially surround the portion of the papers P between the edge surface $p_1$ and the slit-shaped aperture h. Even if the thickness of the papers P to be bound and/or the binding width are a little larger than those obtained from the foregoing calculation, the bonding tape 7 will, nevertheless, surround the paper. Even if the tape is not completely adhered to the above surface portions, it does not prevent the papers P from being satisfactorily bound.

A countermeasure insuring against slight tape shortage can be taken by making the tape length a little longer than the predetermined length and/or the length from the edge surface $p_1$ to the position where the slit-shaped aperture h is bored set a little shorter, and/or the thickness of the papers P reduced.

The bonding tape units 7' are separated by a hole or aperture 10 positioned between the ends of adjacent discrete tape units 7'. The holes 10 are bored through the carrier tape 8 and are used to forward the binding tape assembly 6 so that the tape units 7' to be subsequently used may be fed into the binding mechanism 3. The tape forwarding holes 10 are engaged by a forwarding projection 28 (FIG. 6) provided at the feed mechanism 5, which indexes the binding tape assembly 6 in a ganged relation away from the boring mechanism 2. The feed mechanism 5 also operates to peel the bonding tape 7 from the carrier tape 8, preparing the binding tape assembly 6 for the next binding operation.

On the other hand, the carrier tape 8 is larger in width than the bonding tape 7, and both of the side edges 8*a* and 8*b* of the carrier tape 8 are used as marginal press surfaces to flex the tape where bonding tape 7 is not bonded.

The binding tape assembly 6 described above is preferably provided with bonding tapes 7 which are precut at the predetermined intervals, although the bonding tapes 7 can be provided as a continuous strip held by the carrier tape 8 so that the strip can be peeled from the carrier tape 8 and then cut by a tape cutter into individual tapes at optional and random intervals before being inserted in the binding mechanism 3.

The holes 10 provided in binding tape assembly 6 are not limited to the shape shown in FIG. 2. Instead of the holes, the binding tape assembly 6 can have notch portions, not shown, which are provided by cutting the marginal side edges of the carrier 8 so as to engage with the above projection 28 or a similar projection. The bonding tape 7 or the carrier tape 8 can be gripped on both of their surfaces by roller-shaped members to forward it. According to the embodiment shown in FIG. 1, the binding tape assembly 6 is housed in a case C in a condition by which the binding tape assembly 6 is rolled around a cylindrical core. The binding tape assembly 6 can be easily loaded and unloaded, allowing the tape roll to be freely exchanged.

In another embodiment, not shown, in which the tape forwarding aperture or hole 10 is not provided, a tape feeder (a tape feeding apparatus) can be provided separately.

The binding machine using the binding tape assembly 6 according to the embodiment of the present invention is explained with reference to FIGS. 1 and 4–13.

The binding machine 1 comprises a housing 11 formed by combining substantially symmetrical left and right half housings 11*a*, 11*b* in a detachable assembly. A casing 12 housing the main boring mechanism 2 and the binding mechanism 3 is formed substantially at the center of the housing 11 so as to have the shape of an erect cylinder with an opening 12*a* on its top. Located at the front of the casing 12 is a base 13 having an upper surface 13*a* on which the stack of papers P is placed. To the rear of the casing 12 there is formed a cassette holder 14 in which the cassette C holding the endless binding tape assembly 6 is inserted.

Figure 5:
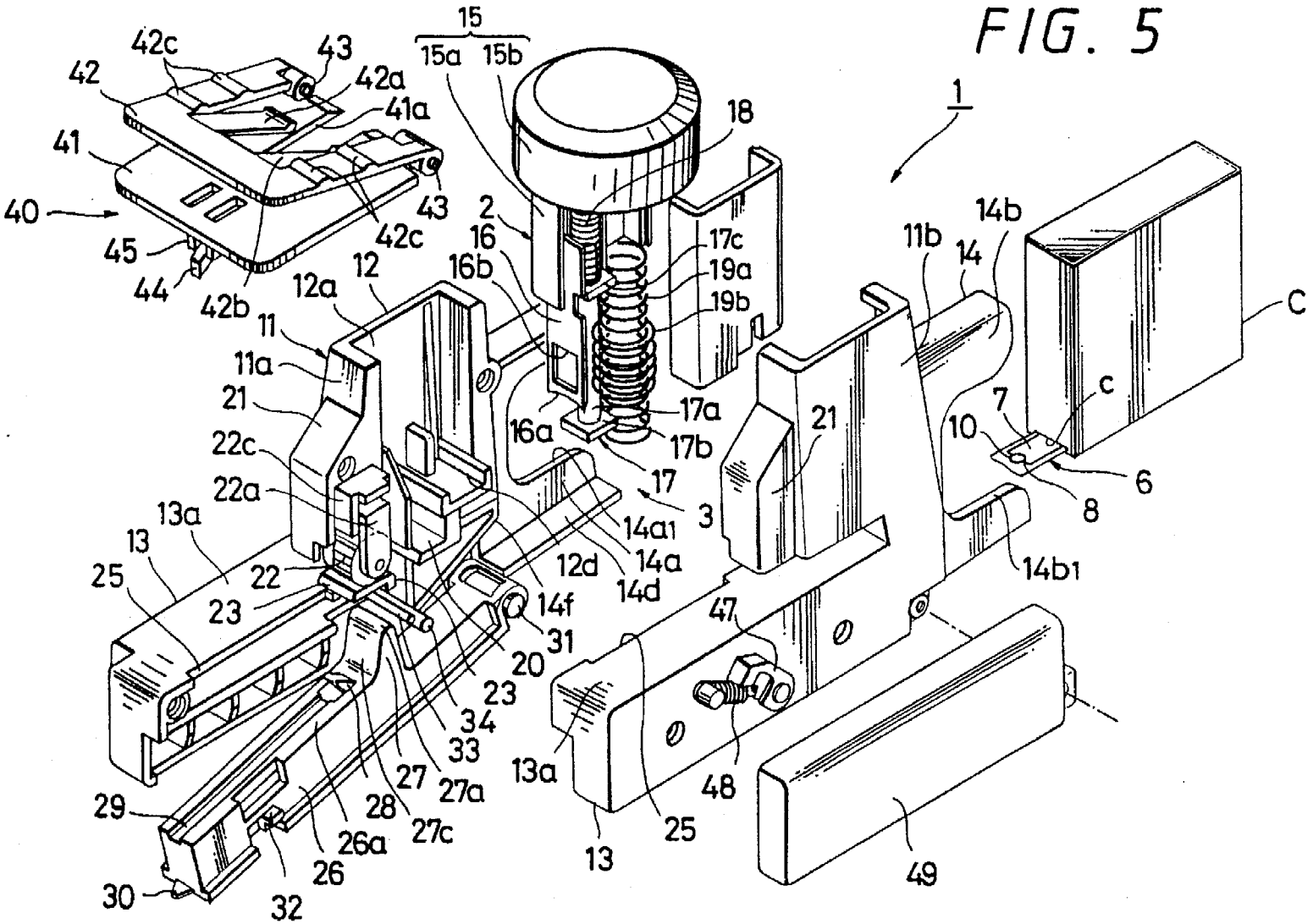
FIG. 5 is an exploded view of the binding machine shown in FIG. 4.

As shown in FIGS. 1 and 5, a plunger 15 is inserted into the casing 12 through the upper opening portion 12*a* of the casing so that the plunger 15 is movable in upward and downward directions. The plunger 15 comprises a cylindrical skirt 15*a* for holding the operating mechanism and a handle 15*b* fixed to the upper end of the skirt 15*a*.

As seen in FIG. 5, the skirt 15*a* holds a blade 16 and a piston 17, which are the main elements of the boring mechanism 2 for cutting the holes 10 through the papers to be bound. The blade 16 is removably held by the skirt 15*a* so that its cutting edge 16*a* projects downwardly. The piston 17 includes a shaft 17*a*, a head 17*b* horizontally fixed on a lower end of the shaft 17*a*, and a collar 17*c* fixed on the shaft 17*a* at a position spaced from its upper end by a predetermined length. The piston 17 is held within the skirt 15*a* so as to project downwardly relative to the blade 16 and is movable in the upward and downward directions. A spring 18 formed as a compression coil spring, for example, is disposed between the collar 17*c* and the lower surface of the handle 15*b*. The plunger 15 includes a first restoring spring 19*a* and a second restoring spring 19*b*, both of which are formed of compression coil springs. The first restoring spring 19*a* is attached at its upper end to the lower surface of the handle 15*b* so as to hang downwardly therefrom. The second restoring spring 19*b* is arranged so that the lower half of the first restoring spring 19*a* is inserted into the second restoring spring 19*b*.

As shown is FIG. 1, the casing 12 is formed with an opening 12*b* into which the blade 16 is inserted; a opening 12*c* in which the shaft 17*a* is inserted; and a dish-shaped bearing surface 12*d* for supporting the lower ends of the first and second restoring springs 19*a* and 19*b*. A counter piece 12*e* is formed at the front edge of the insertion opening 12*b* so as to project downwardly.

The papers to be bound are moved across the surface 13*a* from the front. The surface 13*a* lies just below the casing 12. A stop mechanism 20 for positioning the binding edge of the papers to be bound is provided below the opening 12*c*. The stop mechanism 20 is opposed to the plunger head 17*b* and consists of a mount surface 20*a* for supporting the binding edge of the papers and a projecting contact surface 20*b* along which the rear edge of the plunger head 17*b* slides and with which the binding stop mechanism 20 has a cross section in the shape of a reversed letter L.

The shaft 17*a* of the piston 17 is inserted into the supporting opening 12*c* by inserting the plunger 15 into the casing 12 and the first and second restoring springs 19*a*, 19*b* are mounted on and brought at their lower surfaces into contact with the bearing surface 12*d*. Then, the plunger 15 is slidably pushed upward by the restoring spring force of the first restoring spring 19*a* and positioned at the upper end of the casing 12 while projecting considerably from the upper opening 12*a*. In this state, the blade 16 is located above the insertion opening 12*b* so as to be spaced therefrom at a predetermined distance. The head 17*b* of the piston 17 is located above the stop mechanism 20 so that its lower surface is opposed to the mount surface 20*a* at a predetermined distance and its rear edge slidably in contact with the surface 20*b*.

When the plunger 15 is pushed down within the casing 12 against the first restoring spring 19*a*, the head 17*b* is brought in contact with the surface 20*a* of the stop mechanism 20. The head 17*b* presses against the surface 20*a* because of the force applied to the piston shaft 17*a* by the spring 18. When the plunger 15 is pushed further downward, it compresses the second restoring spring 19*b* and moves the blade 16 to the base surface 13*a* through the opening 12*b* and then below the base surface 13*a* through the opening 12*b*. At this time, the head 17*b* of the piston 17 is pressed against the surface 20*a*.

When the plunger 15 is released, the plunger 15 slides and is forcibly returned upward by the double restoring spring force of the first and second restoring springs 19*a*, 19*b*. The blade 16 then passes upwardly through the base surface 13*a* into the opening 12*b*. In this state, the head 17*b* is kept pressed against the surface 20*a* by the spring force of the spring 18, and the plunger 15 is only slightly raised by the first restoring spring 19*a*. When this return of the plunger 15 is completed, it is released from pressing against the mount surface 20*a* and resumes its upward movement.

A supporting body 21 having an opening 21*a* at its lower end is located at the front of the casing 12. A presser such as roller 22 formed for example of a synthetic resin and mounted on a U-shaped bracket 22*c* is inserted into the supporting body 21. The roller 22 is provided with a bearing 22*a* and a spring 22*b* so as to be biased to project from the lower opening 21*a* thereof.

As shown in FIGS. 1 and 5, there is mounted directly below the roller 22 and located on the same level as the base surface 20*a* a contact surface 23. The contact surface rests on the base surface 13*a* of the base 13 spatially opposed to the roller 22. A spacer 24 is formed between the contact surface 23 and the stop mechanism 20, into which the blade 16 is inserted. Formed over both half housings 11*a* and 11*b* and through the base surface 13*a* along the center of the base 13 is a slot 25.

The cassette holder 14 housing the cassette C in which the wound binding tape assembly 6 is held extends from the rear of the casing 12. The cassette holder 14 is open to its rear and is provided with side walls 14*a*, 14*b* cut with a curved opening $14a_1$ and $14b_1$, respectively. Along the upper edge of each of side walls 14*a*, 14*b* are formed an inwardly directed flange 14*c*. The flanges 14*c* are inclined in the backward direction and the front surface 14*e* is formed perpendicularly to the inclined lower surface 14*d*. With the cassette holder 14 thus formed, the cassette C can be inserted and removed in a backward and slightly upward diagonal direction by being gripped at its both sides by fingers.

The holder 14 is removably connected to the lower portion of the base 13 through an opening 14*f* formed in the front surface 14*e*.

Located adjacent to the base 13 is a downwardly rotatable tape support 26. The tape support 26 is formed independently of the housing 11 and extends the length of the base 13 from its front end to the cassette holder 14 and is engaged with the housing 11, i.e. between lower portions of both of the half housings 11*a*, 11*b*, thereby becoming integral with the housing 11. The tape support 26 is formed having a tape guiding surface 26*a*, provided midway of its length with a ridge 27 formed as a curved surface 27*a*. The curved surface 27*a* is sharply inclined at its rear side 27*b* and merges with the rear tape support $26a_2$ which is located at a lower level than the forward guide surface $26a_1$. Just forward of the ridge 27 there is located reversing feed blocking projection 28. The projection 28, in the form of a pawl, is inserted an elongated open groove 29 formed in the surface 26*a*. The reversing projection 28 engages with the hole 10 in the carrier tape 8 and is adapted to pull the tape carrier 8 forward from the cassette C.

At the forward end of the tape support 26 there is provided a flat and substantially triangular projection 30 for cutting the waste carrier tape 8.

The tape support 26 is located between both of the half housings 11*a*, 11*b* and is pivotally supported at its rear end portion by a shaft 31, fixed below an opening 14*f* at the bottom of the cassette holder 14, so as to be rotatable downward. The tape support 26 is attached with a stop 32 engaging with and held by both the half housings 11*a*, 11*b*.

Figure 6:
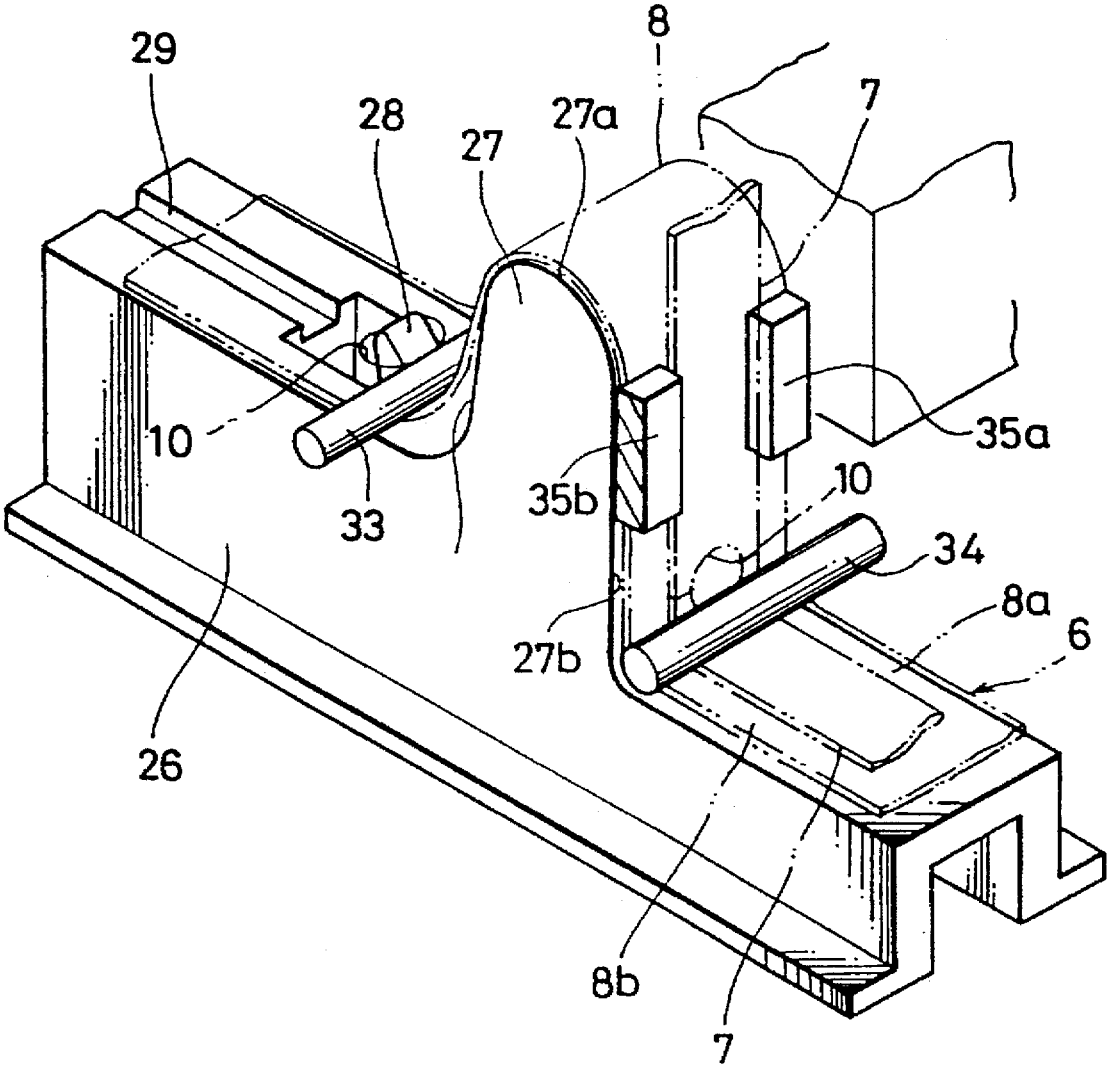
FIG. 6 is an enlarged perspective view of the tape assembly transfer mechanism.

Between the curved surface 27*a* of the ridge 27 and the projection 28 there is located a horizontal positioning pin 33 adapted to lie over the binding tape assembly 6 as it moves into the projection 28. On the rear slope 27*b* a similar pin 34 is located. Both pins 33 and 34 act to maintain the binding tape assembly 6 properly aligned during movement. As shown in FIG. 6, mounted at the edges of the rear slope 27*b* are pressing pieces 35*a* and 35*b* corresponding to the edges. Pieces 35*a* and 35*b* define a passage for each edge 8*a*, 8*b* of the carrier tape 8. The pieces 35*a* and 35*b* are spaced from the surface of the slope 27*b* at an interval substantially equal to a thickness of the carrier tape 8. The ridge 27, the front and rear side guide pins 33, 34 and the pieces 35*a*, 35*b* form, because of their curvature, a peeling unit for peeling the bonding tapes 7 from the carrier tape 8. See FIG. 9.

Figure 4:
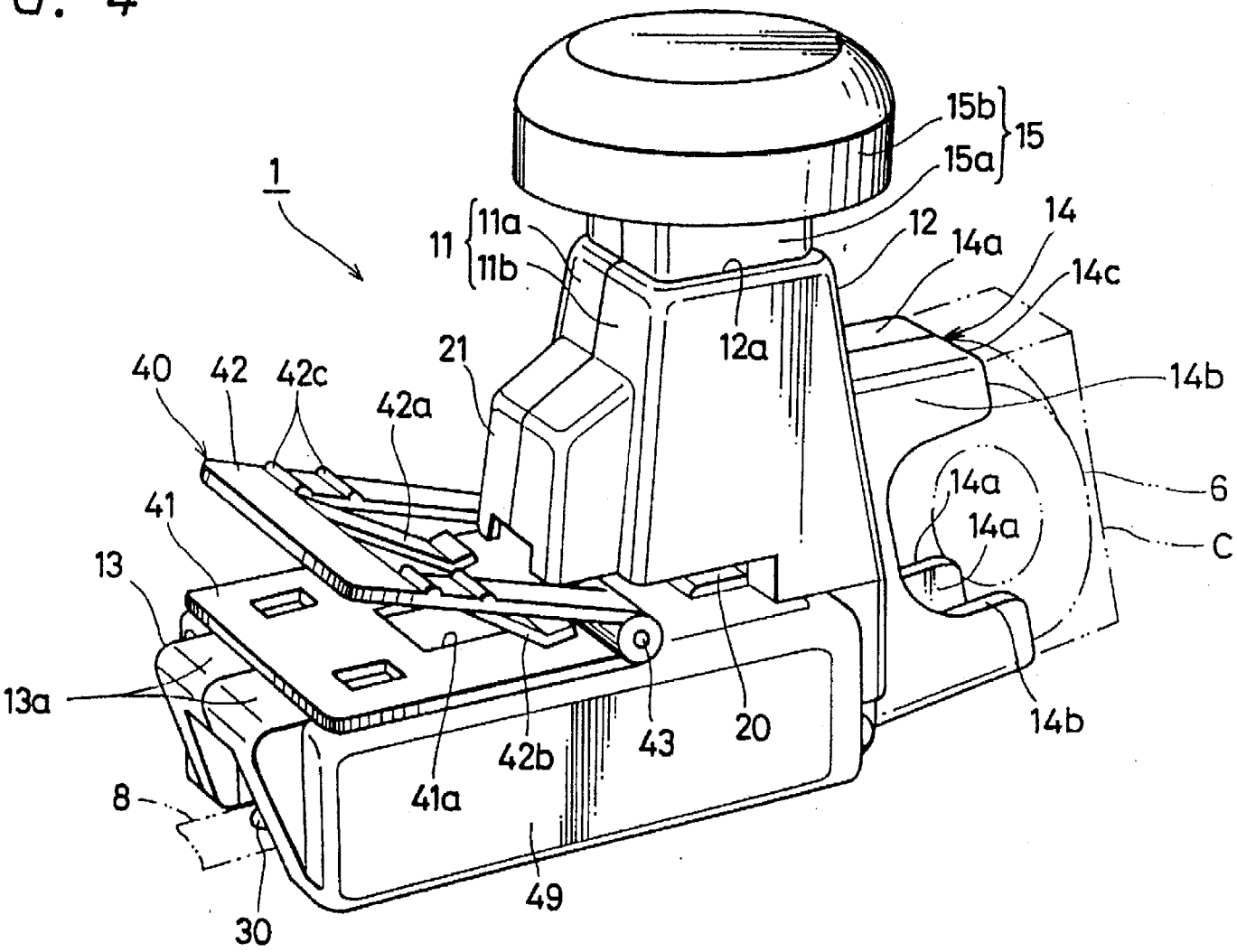
FIG. 4 is a perspective view of the binding machine of the present invention.

As seen in FIGS. 1 and 4, the paper feed mechanism 5 comprises a gripping body 40 located above the surface 13*a*. The gripping body is adapted to grip and slidably move the papers toward the main mechanism within the casing 12, i.e., the boring mechanism 2 and the binding mechanism 3.

The movable gripping body 40 has two quadrangular gripping boards 41, 42 which are connected to each other at one side by hinge pins 43. The lower board 41 is provided with a guide opening 41*a* having a width substantially equal to the width of the above-mentioned press contact surface 23 on the base 13. The opening 41*a* is formed inward from the hinge connection edge toward the center of the board.

Extending inwardly into the opening 41*a* are spring fingers 42*a*, 42*b*, which press against the surface of the lower gripping board 41 so as to cause the upper gripping board to be tilted upward in a direction from the free end side portion toward the hinge. Projections 42*c* are formed on the upper surface of the gripping board 42. The spring fingers 42*a*, 42*b* may be formed as a plate spring or the like independent of the gripping board 42.

Figure 7:
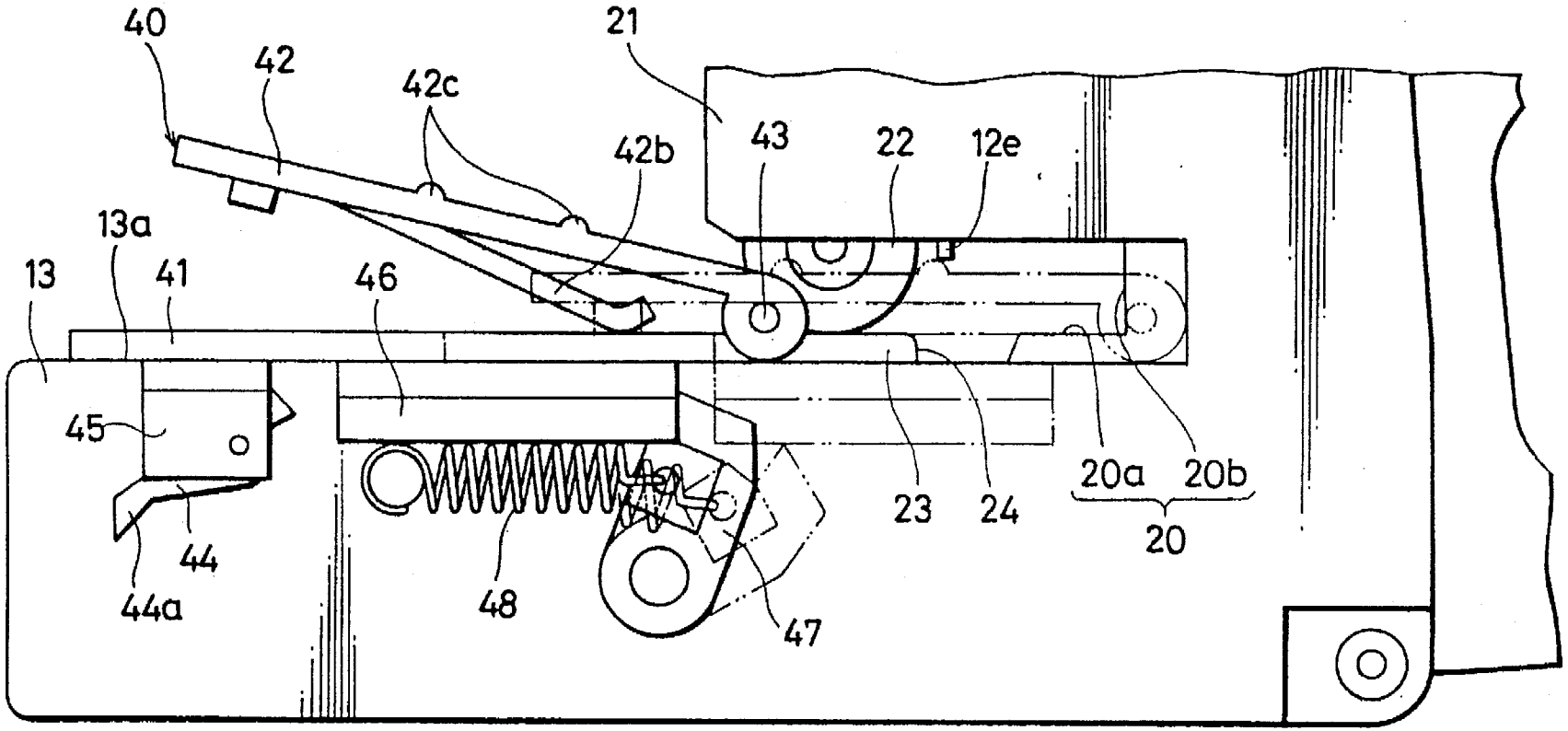
FIG. 7 is a side elevational view of the mechanism for inserting the tape assembly.

As shown in FIGS. 1 and 7, a forwarding pawl 44, engageable with the tape forwarding apertures 10 of the carrier tape 8, is supported by a frame 45 at substantially the center of the lower surface of the lower gripping board 41 so as to be pivotable in the upward and downward directions. The pawl 44 is biased by a biasing member, not shown, such as a spring or the like so that its tip end engaging portion 44*a* is constantly projected downward. The frame 45 is inserted into the slot 25 so that the tip end 44*a* of the pawl is inserted into the open groove 29 of the tape support 26.

Extending downward from the lower surface of the lower board 41 is a long guide piece 46. The guide piece 46 is in slidable contact with one side surface of the housing 11, i.e., an outer surface of the right half housing 11*b*.

As seen in FIG. 7, a stop cam 47 is pivotally mounted on the outer surface of the right side half housing 11*b* behind the guide piece 46. The cam 47 is freely rotatable in the forward and backward directions and is rotatably biased by a spring biasing member 48 such as a coil spring or the like in the forward direction. The stop cam 47 is slidably in contact with the lower surface of the guide piece 46 while rotated backward against the biasing force of the spring biasing member 48. Since the stop cam 47 can be brought into contact with the rear end of the guide piece 46, the biasing force causes the stop cam 47 to press the guide piece 46 forward. On the other hand, when the guide piece 46 is moved rearwardly, the stop cam 47 is pivoted and slidably rides on the lower surface of the guide piece 46. In other words, when the guide piece 46 is slidably in contact with the stop cam 47, the movable gripping body 40 can be freely moved in the forward and backward directions on the surface 13*a* of the base 13. When the movable gripping body 40 is brought to the front end of the base 13, the guide piece 46 is brought in contact with the stop cam 47 at its rear end surface to stop the movable gripping body 40. When the movable gripping body 40 is moved in the forward direction and when the guide piece 46 is about to leave its contact with the stop cam 47, the stop cam 47 is brought in contact with the rear end surface of the guide piece 46, which is pressed forward by the biasing force of the spring biasing member 48 so that the movable gripping body 40 is automatically returned to the front end of the base 13 and then stopped.

When the movable gripping body 40, in the stopped state, is moved backward, it is pressed against the biasing force of the stop cam 47 and then the guide piece 46 rotates the stop cam 47 backward by pushing the stopping cam 47 backward. The stop cam 47 slides along the guide piece 46 so that the movable gripping body 40 can be freely moved backward as described above.

As shown in FIG. 4, a cover 49 fits over the outer side surface of the right half housing 11*b* to enclose the slidable guide piece 46 and the pivotal stop cam 47.

Figure 8:
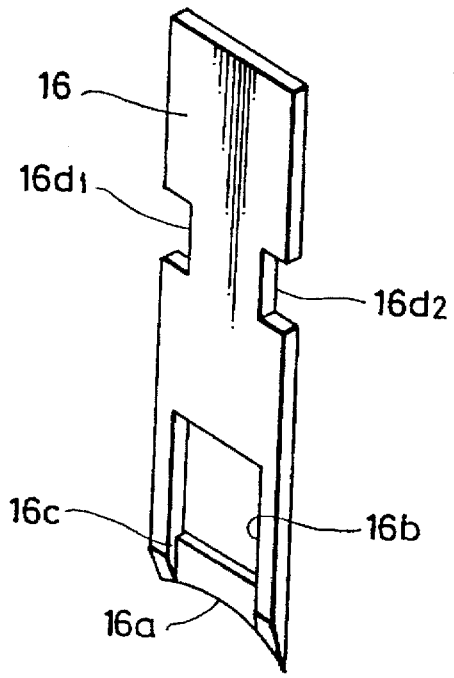
FIG. 8 is an enlarged perspective view showing the knife for making the aperture.
Figure 9:
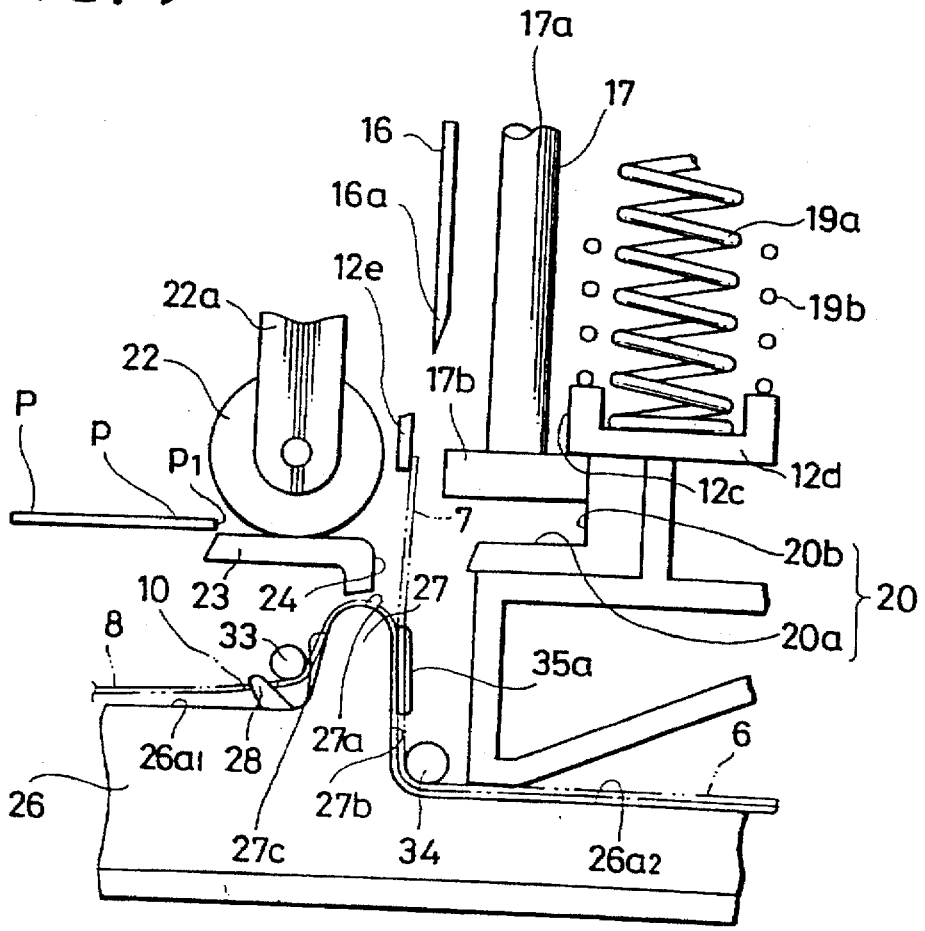
FIG. 9 is an enlarged schematic illustrating the operation of the binding machine (in an initial state)
Figure 10:
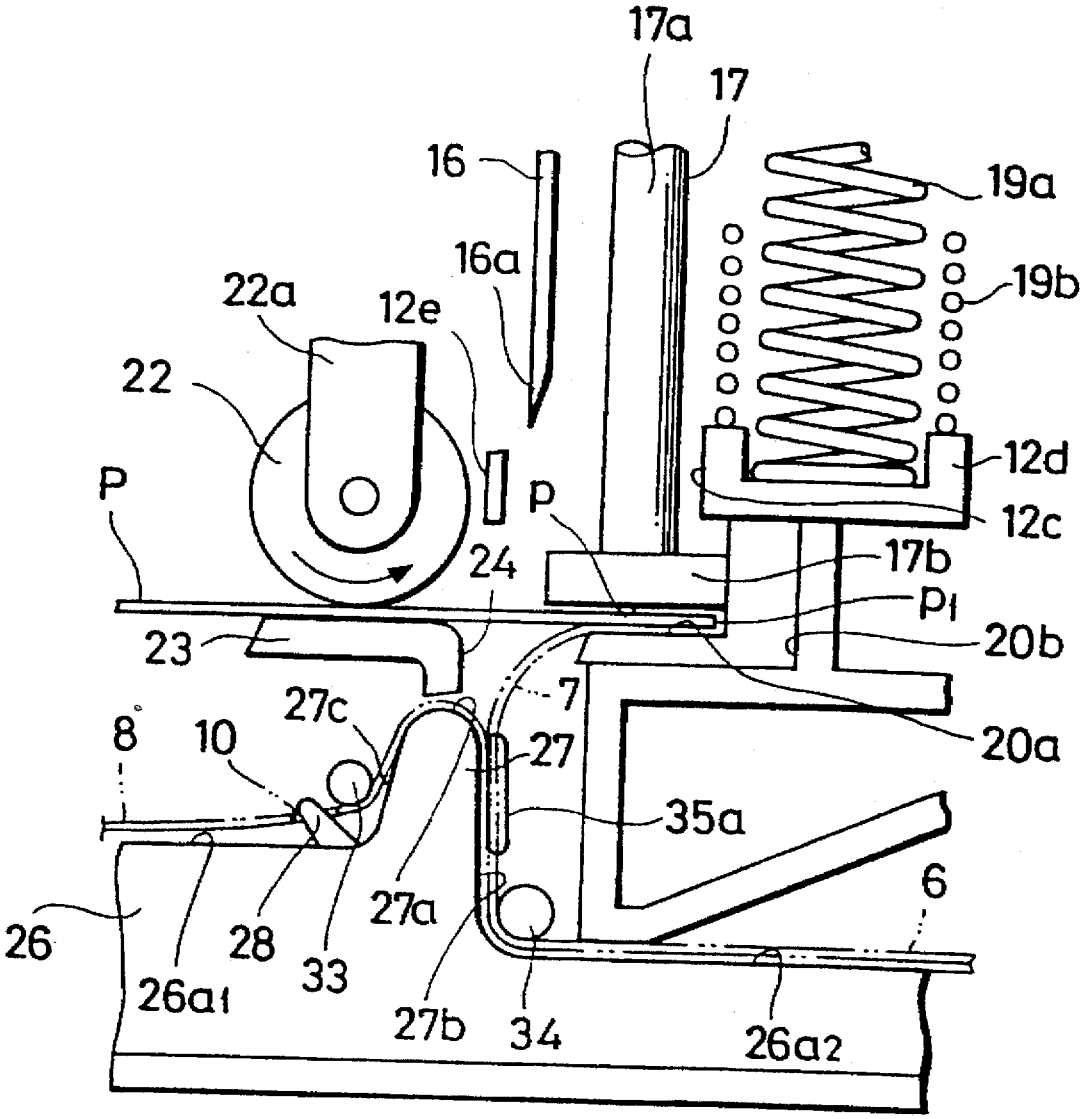
FIG. 10 is an enlarged schematic illustrating the operation of the same binding machine (in a state in which the papers to be bound are gripped)
Figure 11:
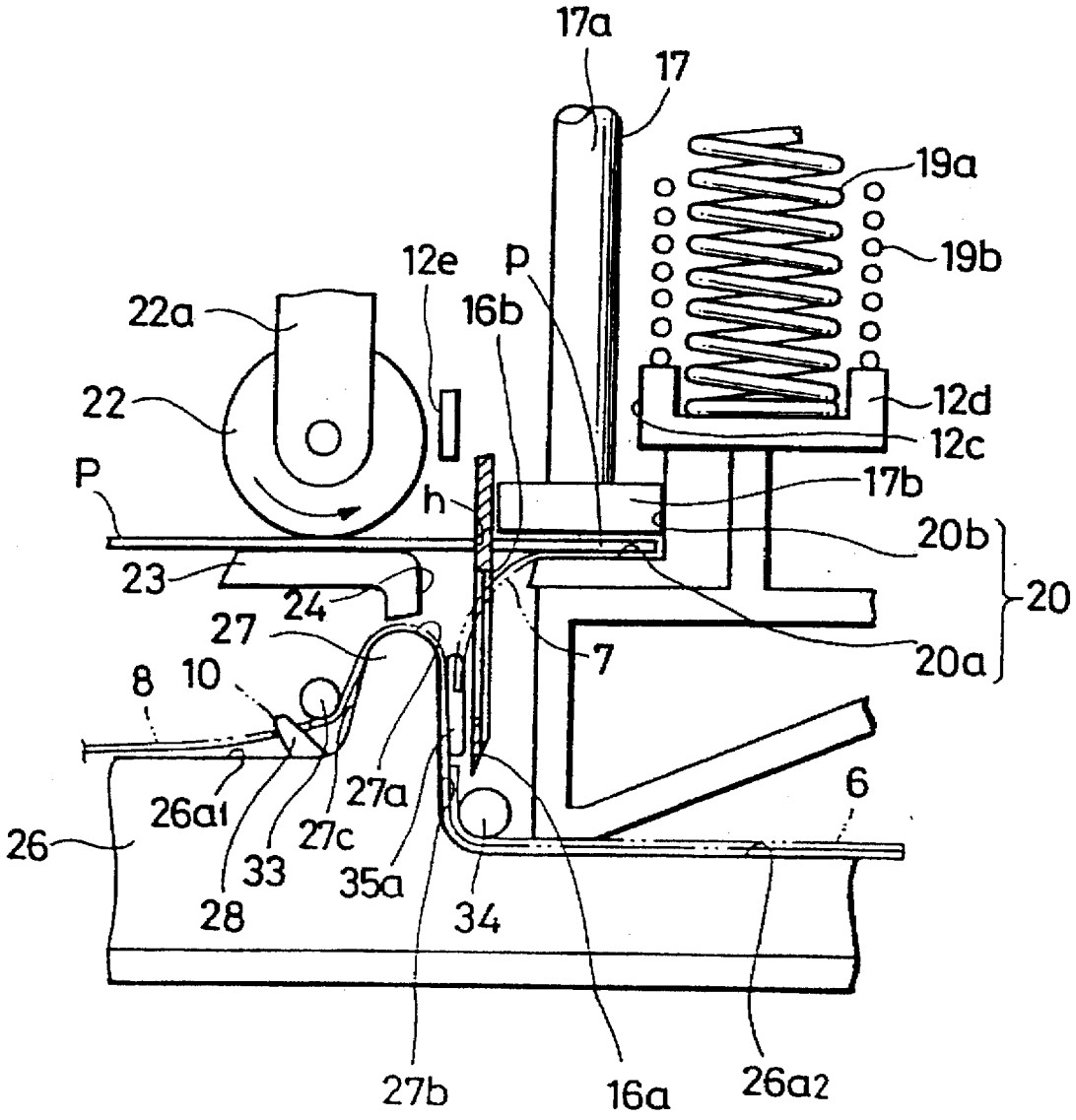
FIG. 11 is an enlarged diagram used to explain the operation of the binding machine (in a state in which the knife blade is inserted into the papers for cutting)
Figure 12:
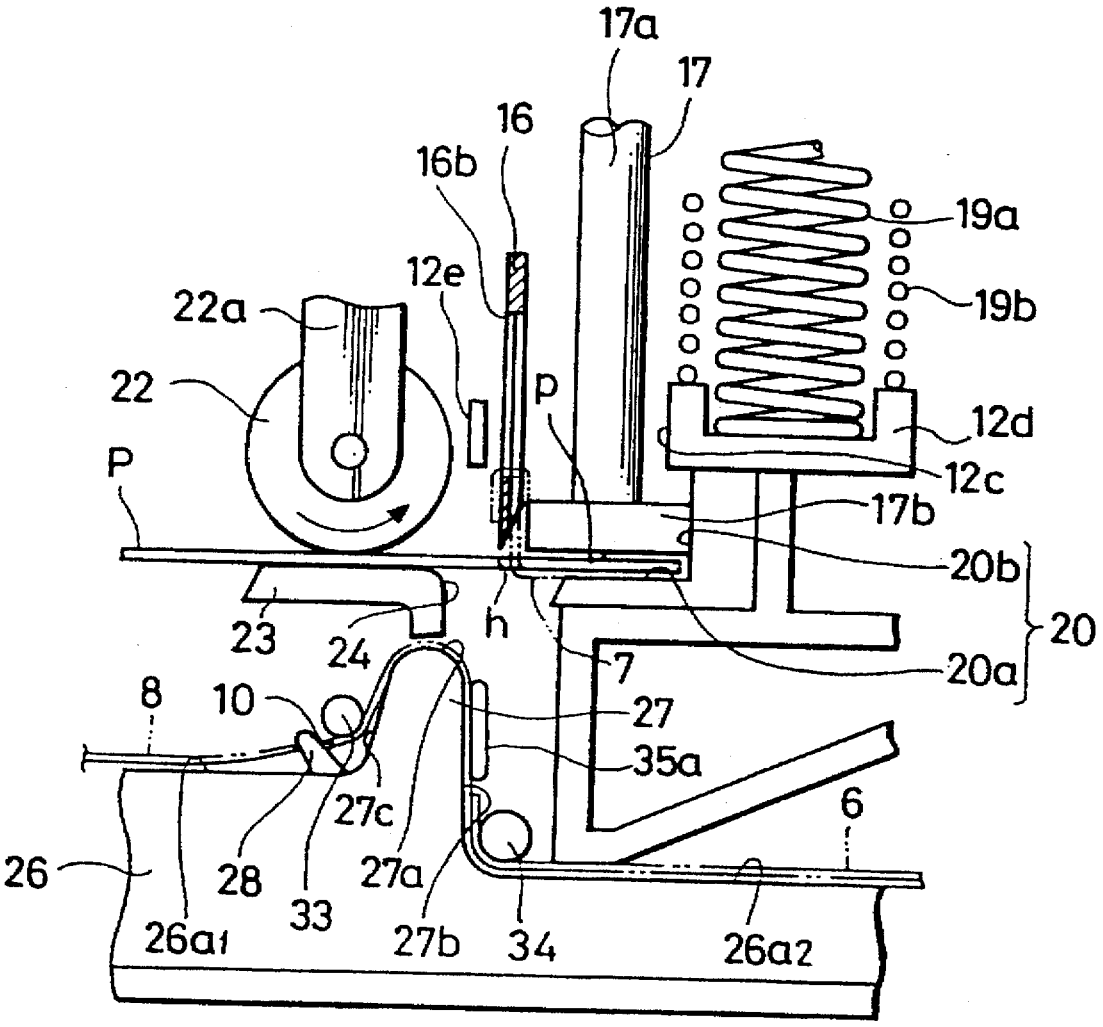
FIG. 12 is an enlarged schematic illustrating the operation of the binding machine (in a state in which the knife blade is returned)
Figure 13:
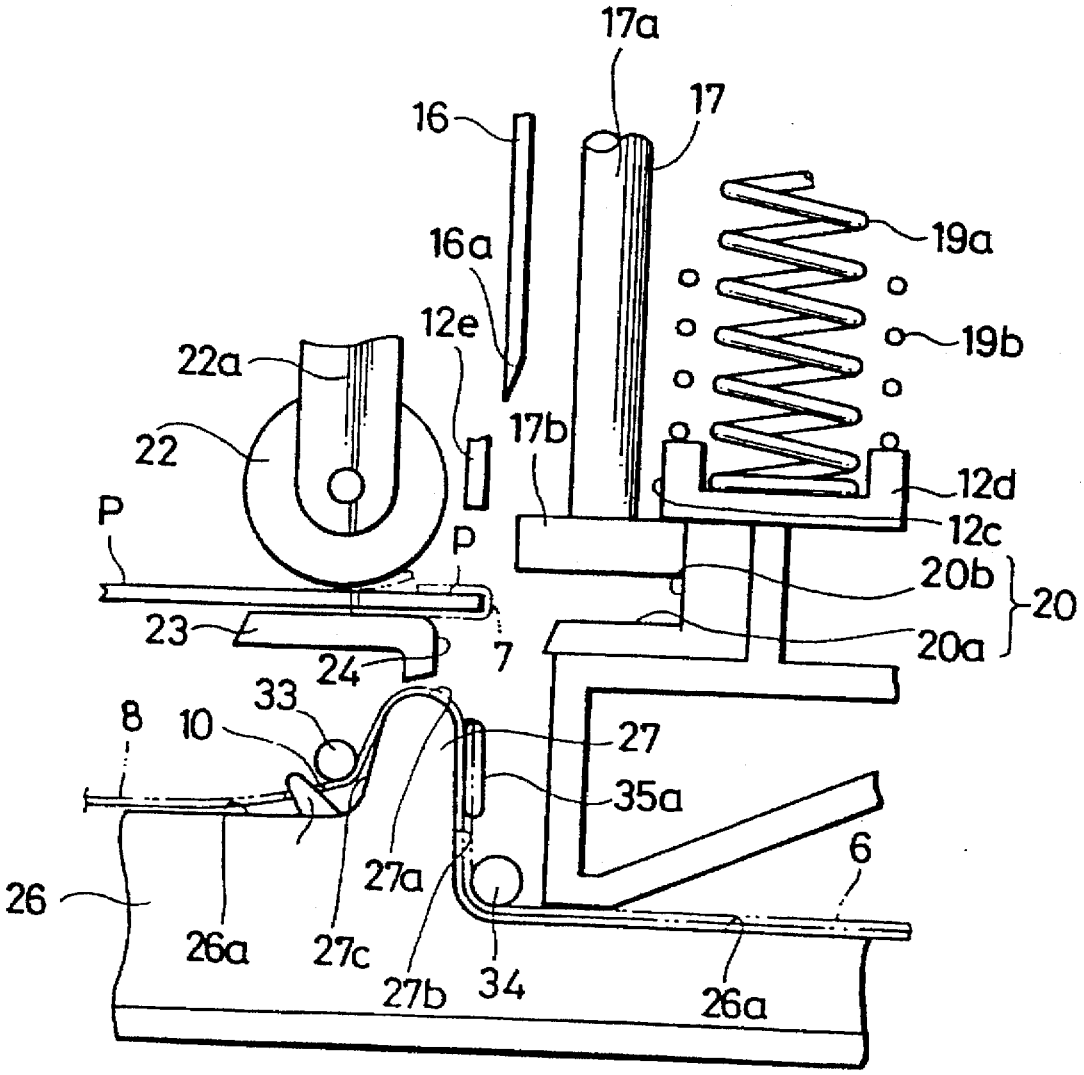
FIG. 13 is an enlarged schematic illustrating the operation of the binding machine (in a state in which the bonding tape is completely bonded on the papers).

As seen in FIG. 8, the blade 16 is a flat body having a wider width as compared with the predetermined width of the bonding tape 7. The blade is provided at its tip end with a knife edge 16*a* curved at its center. A tape insertion aperture 16*b* is bored through the blade 16 adjacent to the blade edge 16*a* so as to have a slightly wider width as compared with the bonding tape 7. A tape guide groove 16*c* having the same width as that of the tape insertion aperture 16*b* is formed between the tape insertion aperture 16*b* and the blade edge 16*a*.

Concave recesses $16d_1$, $16d_2$ are formed on both side edges of the blade body, displaced slightly toward the rear end thereof from a center thereof. The concave recesses $16d_1$, $16d_2$ engage with and fit within the above-mentioned skirt 15*a* of the plunger 15 (See FIG. 1). The tape guide groove 16*c* is not always necessary.

The operation of the described binding machine is hereinafter explained.

Before the binding operation, several preparatory operations are done. The tape cassette C housing a roll of binding tape is loaded into the cassette holder 14 through its rear surface opening 14*c*. Then, the binding tape assembly 6 is drawn through the slit opening c (FIG. 5) located at a front lower end of the cassette C and brought through the front surface opening 14*f* to a point below the base 13, which is made available by rotating the tape support 26 downward. The binding tape assembly 6 is drawn from the cassette C so that the bonding tape 7 is located on the upper surface of the carrier tape 8.

The binding tape assembly 6 as seen in FIG. 6 is thus drawn so as to be located under the front and rear guide pins 33, 34 and the front and rear pressing pieces 35*a*, 35*b*. In this state, the tape support 26 is closed, engaged with the housing 11 and stopped by the engaging stop 32. The binding tape assembly 6 is located along the tape guide surface 26*a* and brought in contact with the circumferential surface of the ridge guide portion 27 be being gripped by the front and rear guide pins 33, 34. The binding tape assembly 6 is pressed at both side edges of the carrier tape 8, i.e. along the edges 8*a*, 8*b* by the pressing pieces 35*a*, 35*b*.

When the movable gripping body 40 is moved toward the rear end of the base 13, i.e. toward the casing 12, the forwarding pawl 44 slides on the binding tape assembly 6 without being engaged with the tape forward holes 10 of the binding tape assembly 6.

When the movable gripping body 40 is then slidably returned from the rear or main casing 12, the forwarding pawl 44 engages with one of the tape forwarding holes 10 of the binding tape assembly 6, passing into the open groove 29 of the tape support 26. Therefore, the binding tape assembly 6 can then be drawn by an amount of one interval between the adjacent tape forwarding holes 10 on sliding the gripping body 40 forwardly.

While being drawn and moved, the binding tape assembly 6 is sharply folded and substantially turned up along the curved surface 27*a* of the ridge 27 with the carrier tape 8 pressed at both of its side edges 8*a*, 8*b* by the pressing pieces 35*a*, 35*b*. Therefore, since the bonding tape 7 is releasably adhered to the carrier tape 8 and being divided into sections of predetermined length, the bonding tape 7 is peeled from the carrier tape 8. When so peeled, the bonding tape 7 projects upward from the spacer 24 formed between the positioning stop mechanism 20. At this time, the bonding tape 7 is held with its front end temporarily bonded to the contact piece 12*e* (see FIGS. 1 and 9) with its rear end portion being adhered to the carrier tape 8. In this state, the tape forwarding holes 10 of the carrier tape 8 is engaged with the reversing feed projection 28 of the tape support 26.

As described above, the preparatory operations for the binding operation are completed. Then, when the papers P are to be bound by the binding machine 1, the papers P are held by inserting its binding edge p between both of the gripping boards 41, 42 of the movable gripping body 40. The gripping body is returned to the front position of the base 13 while holding the papers P between the fingers 42*a*, 42*b* and the gripping board 41 (in a state shown by a two-dot chain line shown in FIG. 1). When in this state, the movable gripping body 40 is slidably moved backward, i.e., toward the casing 12 housing the main mechanism, and forced therein so that the guide opening groove 41*a* of the lower gripping board 41 corresponds to the press contact surface 23, the binding edge p is gripped between the press contact surface of the contact surface 23 and the rotating roller 22 and then inserted into the lower portion of the casing 12 housing the main mechanism. At this time, the bonding tape 7 held in the peeled raised state is bonded to the edge surface $p_1$ and then brought onto the positioning stop mechanism 20. The bonding tape 7 is folded and positioned at a point slightly extended downward from the spacer 24 with its front half portion being located between the binding edge p and a sidewise U-shaped surface. The U-shaped surface is formed of a portion from the stop surface 20*a* and the projected contact surface 20b to the lower surface of the piston face 17b and with its rear half portion being bonded to the carrier tape 8. When the bonding tape 7 is peeled from the carrier tape 8, the carrier tape 8 while pulled by the bonding tape 7 is engaged with and held by the reversing feed blocking projection 28 so that the bonding tape 7 is smoothly peeled.

When the plunger 15 is pushed down by pressing the pressing the handle 15b against the restoring spring force of the first restoring spring 19a, the piston 17 is pressed and lowered by the compression spring 18 into contact with the front end of the front half of the bonding tape 7. The piston 17 is pressed onto the binding edge p of the papers P compressing the binding edge p together with the stop surface 20a. Therefore, the bonding tape 7 is tightly bonded at its front half to the portion from an upper surface p, through the edge surface $p_1$ thereof, to the lower surface thereof (see FIG. 10).

When the plunger 15 is further pressed, it is moved downward, contracting the second restoring spring 19b as described above. The blade 16 is lowered through the insertion opening 12b. The blade edge 16a of the blade 16 reaches the surface p, where it held by the pressing pressure of the plunger 15. The blade 16 bores a slit-shaped aperture h having the same size as the lateral cross section of the blade 16 through the surface p and passes through the spacer 24 below the base 13. At a position where the blade 16 is inserted, the rear half portion of the bonding tape 7 is positioned with its rear end being adhered to the carrier tape 8. When the blade 16 is inserted, the rear half portion of the bonding tape 7 is slidably brought in contact with the blade 16 and then peeled from the carrier tape 8. At the same time, the rear half portion thereof is inserted into the tape insertion aperture 16b of the blade 16 by a restitution force created by the memory of the rear half portion as a result of its being peeled off (see FIG. 11). While the blade 16 is boring the aperture, the piston 17 keeps pressing the surface p of the papers P as a consequence of the contracted spring 18.

When the plunger 15 is stopped, it is returned upward with a strong stroke by the double restoring spring force obtained from the first and second restoring springs 19a, 19b. At the same time,. the blade 16 is also lifted together with the plunger 15 so that the blade 16 can be reliably drawn through the spacer 24 from the aperture h bored through the surface p of the papers P. At this time, the rear end portion of the bonding tape 7, inserted into the tape insertion aperture 16b of the blade 16, is brought upward through the aperture h as the blade 16 is lifted (see FIG. 12). While the blade body 16 is being pulled out, the rear end portion of the bonding tape 7 is kept inserted in the tape guide groove 16c between the blade edge 16a of the blade 16 and the tape insertion aperture 16b thereof so as not to project outward from the blade 16. The piston 17 keeps compressing the surface p because it is biased by the spring 18. Therefore, the rear end portion of the bonding tape 7 can be smoothly drawn through the aperture h.

When the plunger 15 is completely returned, the piston 17 is lifted up, and the pressing piece 17b leaves exposed the surface p of the papers P.

When the movable gripping body 40 is slidably drawn forward from the lower side of the casing housing the main mechanism, the surface p of the papers P passes between the rotating roller 22 and the press contact surface 23. When the surface p is passed therebetween, the rear end portion of the bonding tape 7 drawn to the upper surface of the surface p is folded over by the rotating roller 22 and is bonded to surface p in the shape of a substantially reversed letter C. Then, the rear end portion of the bonding tape 7 is gripped and pressed together to the surface p by the rotating roller 22, which is pressed by the spring member 22c, and the press contact surface 23. As a result, the whole surface of the bonding tape 7 is tightly bonded to the surface p (see FIG. 13).

The movable gripping body 40 is then slid and drawn to the front end of the base 13 to detach the papers P bound by the bonding tape 7. The papers P are thus bound by the bonding tape 7 in a state shown by an arrow a in FIG. 3.

When the movable gripping body 40 is slid and drawn, the forwarding pawl 44 is engaged with the tape forwarding hole 10 of the binding tape assembly 6 to forward the carrier tape 8 from which the bonding tape 7 may be peeled. When the movable gripping body 40 is moved to the front end of the base 13, the guide piece 46 is pressed by the stop cam 47 in the forward direction. The movement of the movable gripping body 40 causes the binding tape assembly 6 to be forwarded by a length of the next one unit. When the binding tape assembly 6 is forwarded, i.e., the carrier tape 8 is moved, the next bonding tape 7 is held, partially peeled from the carrier tape 8, similarly to the above-mentioned preparatory operations and ready for the next binding operation.

A subsequent stack of papers P are bound by a bonding tape 7 as described above. The carrier tape 8 is successively forwarded and ejected from the front end surface side of the tape support 26, being cut and removed, by engaging its tape forwarding hole 10 with the cutting projection 30 provided on the front end of the tape support 26.

The bonding tape 7 has a length obtained by adding twice the length from the edge surface $p_1$ of the papers P to the aperture h to twice the thickness of the papers P to be bound, i.e., the length of the bonding tape 7 is set to a length sufficient to substantially surround the portion between the edge surface $p_1$ of the papers P and the aperture h. Differences in thickness of the papers P to be bound can be resolved by setting the usual length of the bonding tape 7 a little longer than stated. In other words, when the papers P to be bound are thin, the end portions of the bonding tape 7 are bound overlapping each other, while when the papers P to be bound are comparatively thick, the head end of the bonding tape 7 and the tail end thereof are bound with a short space therebetween and without being overlapped.

Employing the processes described above, the tape 7 may be inserted in various ways (see FIG. 3). One end of the bonding tape 7 is bonded to the upper surface along a side edge of the papers P and is then perpendicularly folded and adhered to the edge surface $p_1$ of the papers P. The bonding tape 7 is thereafter further perpendicularly folded and bonded to the lower surface of the papers P and subsequently inserted through the tape threading aperture h and bonded to an end surface where the aperture is provided. When the papers P are drawn, the bonding tape 7 is first perpendicularly folded to adhere the other end thereof to the upper surface around the aperture h of the papers P. As a result, as shown by the construction denoted by arrow a in FIG. 3, the bonding tape 7 is folded in a tubular fashion so as to surround the edge of the papers P. The tape 7 has a cross section having a shape of the letter C counterclockwise turned at an angle of 90°. The bonding tape 7 does not always have to have the shape of the letter C clockwise turned at an angle of 90° and may have shapes of the letter U counterclockwise or clockwise turned at an angle of 90° as shown by arrows b and c in FIG. 3, respectively. The tape threading apertures h can be bored at two optional positions which are not limited to the end portion of the papers P as shown by an arrow d in FIG. 3, thereby bonding the bonding tape 7 in a shape substantially that of the letter C turned counterclockwise at an angle of 90°.

Two methods of threading the bored aperture h with the bonding tape 7 can be considered: the first as shown in FIG. 1, is that, as described in the above embodiment, the bonding tape 7 is inserted into the tape insertion hole 16*b* provided through the center of the blade 16 after the blade 16 bores the aperture h through the papers P so that when the blade 16 is pulled out, the blade 16 threads the tape insertion hole 16*b* with the bonding tape 7. In the second method, the bonding tape 7 is previously inserted into the tape insertion hole 16*b* before the boring operation and the blade 16 bores the aperture h through the papers P with the bonding tape 7 inserted to thread the aperture h with the bonding tape 7. The method of threading the tape insertion hole 16*b* with the bonding tape 7 is not limited to these methods.

The embodiment, as shown in FIG. 8, requires that the blade 16 be adapted to have the blade edge 16*a* concave and curved upward at its center. The shape of the blade 16 is not limited to the above shape. When the papers are thick, it is desirable that an ordinary blade, formed in the form of a single blade edge which is convex and sharply curved downward at its center, be used. The number of blades or blade bodies is not limited to one but a blade having a plurality of blade edges can be adopted. It can be freely selected whether the blade edge 16*a* is single-blade-edged or double-blade-edged and in which direction the blade edge is directed. A method in which a machine such as a puncher or the like bores a circular aperture through a corner of the papers may be employed. In this embodiment, a small aperture with a predetermined width is bored through the end portion of the papers P by using a box-shaped boring blade forming a rectangular aperture or a circular-shaped boring blade forming a round hole. The passage of the bonding tape 7 through the bored aperture h may be facilitated by the enlarged openings. While the blade lifts the bonding tape to the upper surface of the papers P through the bored aperture in this embodiment, the wider aperture enables the bonding tape 7 to be passed through the bored aperture h with ease, so that it is unnecessary to pass the bonding tape 7 through the bored aperture h as described in the primary embodiment.

While the blade 16 bores the aperture h through the papers P in a vertical direction downward from above the papers P, the blade 16 can bore the aperture h in a vertical direction upward from a position below the papers P. While the bonding tape 7 is inserted into the tape insertion aperture 16*b* provided through the center of the blade 16 after the aperture h is bored through the papers P, the bonding tape 7 can be previously inserted into the tape insertion aperture 16*b* before the blade 16 bores the aperture h through the papers P.

Only the first restoring spring 19*a* may be employed as the restoring spring body for slidably returning the plunger 15, and there can be employed a spring member in which the first and second restoring springs 19*a*, 19*b* are integrally formed, i.e., integrally continuously formed so that a spring force at its lower portion should be strong.

The binding machine using the tape according to the present invention enjoys the following effects because it has an arrangement described in detail above and does not use a metal staple.

(1) Since the papers are bound with the bonding tape, the stack becomes considerably thin and is prevented from becoming thick as compared with a stack bound by the conventional stapling machine.

(2) Since the bonding tape as a binding material can be formed of a cellophane, a cloth, a synthetic paper or synthetic resin such as propylene, vinyl chloride or the like, even if the binding tape is fed into a paper cutter, the entire stack of papers can be cut, avoiding any problems with the paper cutter. The use of a tool such as a staple remover or the like is unnecessary for removal of the bonding tape. Further, the user's fingernail is prevented from being injured when the bonding tape is peeled.

(3) Since the bonding tape is made of a material such as paper or the like as described above, the bonding tape never rusts. Therefore, papers which must be kept for a long period of time do not suffer rust damage. Further, the use of a string in lieu of a metal staple to bind a stack of papers is not necessary.

(4) Since the bonding tape is made of paper or the like, there is no risk such that the staple will pierce finger by mistake when the papers are bound. There is no risk such that a metal piece catches the clothing or injures a skin.

(5) Since the sharp blade body bores the apertures through the papers, the aperture can be bored without failure.

(6) Even when a letter opener is used, a blade portion of the opener is not damaged by the paper tape.

(7) Even when the bonding tape is used to wrap material such as food, medicine to be handed to a sick person or the like, the bonding tape can be safely used because a metal piece is prevented from remaining in the food, the medicine and so on.

(8) Since the bonding tape is made of a material such as paper, cloth, synthetic resin or the like, it can be supplied very inexpensively, and hence, use of the bonding tape becomes economical.

(9) Since the bonding tape is made of a material such as paper, synthetic paper, synthetic resin or the like, the bonding tape can be used for advertisement and/or to provide space for written instructions and drawings.

(10) The binding machine can be made either as a desktop device or as a handheld portable device.

As seen from the foregoing, the present invention provides a binding machine using a bonding tape, which is inexpensive and easy to use. Refills of the bonding tape can be inexpensively provided as well.

Having described the preferred embodiments of the present invention with reference to the accompanying drawings, it is to be understood that the present invention is not limited to these embodiments and that various kinds of changes and modifications in shape of the members, arrangement and so on can be effected by one skilled in the art without departing from the spirit or scope of the present invention as defined in the appended claims.

We claim:

1. A tape binding machine comprising:

a binding tape;

a boring mechanism; and a binding mechanism;

wherein said binding mechanism includes a peeling unit for peeling a bonding tape with a predetermined length of said binding tape from an auxiliary tape thereof, a paper pressing body for pressing and bonding a head end of said bonding tape to a front surface of papers to be bound, a rotating pressing body for pressing and bonding a tail end of said bonding tape to a rear surface of the papers, a movable gripping body for gripping the papers to be bound and for slidably inserting the papers to be bound into said boring mechanism, a projection portion provided on a rear portion of said movable gripping body for being engaged with a forwarding aperture of the bonding tape in conjoint relation with movement of the movable gripping body and for forwarding the bonding tape, and threading means having a blade body with a tape insertion aperture for passing said bonding tape through an aperture bored through the papers to be bound.

2. The binding machine according to claim 1, wherein said movable gripping body of the binding mechanism has two rectangular boards which are hinged along one side so as to freely grip said papers and through which hinge there is formed a central opening through which said bonding tape passes.

3. The binding machine according to claim 1, wherein said threading means for threading an aperture with said bonding tape is arranged such that said bonding tape is inserted into the tape insertion aperture of the blade body before a aperture is bored through the papers and the blade body with this tape being inserted thereinto bores an aperture through the papers, whereby the bonding tape is passed through the aperture bored through the papers to be bound at the same time when the aperture is bored.

4. The binding machine according to claim 1, wherein said threading means for threading an aperture with the bonding tape is arranged such that said bonding tape is inserted into the tape insertion aperture of the blade body after an aperture is bored through papers to be bound and is passed through the aperture bored through the papers to be bound when said blade body is pressed and returned.

* * * * *